US011537082B2

(12) United States Patent
Ferri et al.

(10) Patent No.: US 11,537,082 B2
(45) Date of Patent: Dec. 27, 2022

(54) WATCH PROVIDED WITH A CONTROL MEMBER

(71) Applicant: The Swatch Group Research and Development Ltd, Marin (CH)

(72) Inventors: Yvan Ferri, Lausanne (CH); François Gueissaz, Cormondreche (CH); Simon Bourquin, Neuchatel (CH); Pierry Vuille, Les Emibois (CH)

(73) Assignee: The Swatch Group Research and Development Ltd, Marin (CH)

( * ) Notice: Subject to any disclaimer, the term of this patent is extended or adjusted under 35 U.S.C. 154(b) by 163 days.

(21) Appl. No.: 17/038,620

(22) Filed: Sep. 30, 2020

(65) Prior Publication Data

US 2021/0173348 A1 Jun. 10, 2021

(30) Foreign Application Priority Data

Dec. 10, 2019 (EP) ..... 19214810

(51) Int. Cl.
*G04C 3/00* (2006.01)
*G04B 3/04* (2006.01)
*G04G 21/08* (2010.01)

(52) U.S. Cl.
CPC ..... *G04C 3/004* (2013.01); *G04B 3/046* (2013.01); *G04G 21/08* (2013.01)

(58) Field of Classification Search
CPC ..... G04G 21/08; G04G 21/02; G04G 9/0064; G04B 3/046; G04C 3/002; G04C 3/004
See application file for complete search history.

(56) References Cited

U.S. PATENT DOCUMENTS 9,052,696 B2 * 6/2015 Breuillot ..... G04B 3/046
9,753,436 B2 * 9/2017 Ely ..... G04G 21/00
(Continued)

FOREIGN PATENT DOCUMENTS

CN 1236903 A 12/1999
CN 1327549 A 12/2001
(Continued)

OTHER PUBLICATIONS

Combined Chinese Office Action and Search Report dated Oct. 25, 2021 in Patent Applicatio No. 202011426906.1 (with English translation of Category of Cited Documents), 7 pages.
(Continued)

*Primary Examiner* — Edwin A. Leon
(74) *Attorney, Agent, or Firm* — Oblon, McClelland, Maier & Neustadt, L.L.P.

(57) ABSTRACT

A watch includes a control member, for example a crown or a head of a push-piece, which is mounted in a resilient manner on the outer end of an elongated element projecting outside the middle, such that a user can tilt in a self-reverting manner the control member in two dimensions orthogonal and perpendicular to the central axis of the elongated element. At least one proximity sensor is incorporated into the middle of the watch, in a location allowing this proximity sensor to produce an electric signal that represents the tilting of the control member about an axis that is perpendicular to the central axis. A processor generates at least one instruction on the basis of the electric signal provided by at least one proximity sensor, for example to allow the user to browse a menu or a calendar displayed on a digital screen.

13 Claims, 3 Drawing Sheets

(56) References Cited

U.S. PATENT DOCUMENTS

| | | | | |
|---|---|---|---|---|
| 2016/0116306 | A1* | 4/2016 | Ferri | G04B 27/002 250/231.14 |
| 2016/0327911 | A1* | 11/2016 | Eim | G06F 3/0362 |
| 2018/0018026 | A1 | 1/2018 | Bushnell et al. | |
| 2018/0341342 | A1 | 11/2018 | Bushnell et al. | |
| 2019/0302902 | A1 | 10/2019 | Bushnell et al. | |
| 2020/0110473 | A1 | 4/2020 | Bushnell et al. | |

FOREIGN PATENT DOCUMENTS

| | | | |
|---|---|---|---|
| CN | 105547146 | A | 5/2016 |
| CN | 109491230 | A | 3/2019 |
| CN | 109791392 | A | 5/2019 |
| EP | 0 053 487 | A1 | 6/1982 |
| EP | 0 919 959 | A1 | 6/1999 |
| EP | 1 168 113 | A1 | 1/2002 |
| WO | WO 2014/200766 | A1 | 12/2014 |

OTHER PUBLICATIONS

European Search Report dated Jun. 10, 2020 in European Application 19214810.4 filed Dec. 10, 2019 (with English Translation of Categories of Cited Documents), 3 pages.

* cited by examiner

WATCH PROVIDED WITH A CONTROL MEMBER

CROSS-REFERENCE TO RELATED APPLICATION

This application claims priority to European Patent Application No. 19214810.4 filed on Dec. 10, 2019, the entire disclosure of which is hereby incorporated herein by reference.

TECHNICAL FIELD

The invention relates to a watch provided with at least one feature capable of being managed electronically and provided with a control member for controlling said feature.

TECHNOLOGICAL BACKGROUND

Mechanical or electromechanical watches conventionally comprise a stem-crown that allows the position of the hands to be set by rotating the crown, as well as the barrel to be wound in the case of a mechanical watch. In most cases, the crown is located in a rest position close to the case of the watch, and it must be pulled into a setting position to adjust the time and, where appropriate, the date.

Watches are increasingly provided with additional features, such as an electronic display for personal and/or geographic information, for example an agenda, fitness data and position determination data. This is also the case for watches equipped with a mechanical movement, for example by adding an electronic module comprising a digital screen arranged over a part of the dial.

The presence of the aforementioned additional features generally requires specific control means allowing, for example, a function to be selected or a menu to be browsed, etc.

Electronic watches have been developed with a control member of the 'joystick' or 'trackball' type. Examples of these solutions are respectively shown in the European patent documents EP 1168113 and EP 0582150. However, it should be noted that these solutions are not intended for a mechanically-wound watch. The European patent document EP 0582150 further discloses a watch provided with a stem-crown as well as a 'trackball' device. The drawback of the latter solution is that the presence of two control members separated from one another in space is not always ideal from an aesthetic and/or economic standpoint, given that the watch case is more complex to machine. It should also be noted that good sealing of the watch case is more difficult to achieve with the control members of the 'joystick' or 'trackball' type disclosed in the aforementioned prior art.

SUMMARY OF THE INVENTION

The invention aims to provide a watch that overcomes the aforementioned drawbacks. This purpose is achieved by the watch according to the accompanying claims.

A watch according to the invention comprises a control member which controls one or more electronic functions. The control member is mounted in a resilient manner on an elongated element, such that the user can tilt the member in at least one direction and preferably in two dimensions relative to the elongated element. At least one proximity sensor is incorporated into the middle of the watch, in a location allowing this sensor to generate a signal that represents the tilting of the member about an axis that is perpendicular to the central axis of the elongated element. A processor generates at least one instruction on the basis of signals provided by the one or more proximity sensors, for example to allow the user to browse a menu or a calendar displayed on a digital screen of the watch.

BRIEF DESCRIPTION OF THE FIGURES

The invention will be described in more detail hereinafter using the accompanying drawings, given by way of examples that are in no way limiting, wherein.

DETAILED DESCRIPTION OF ONE EMBODIMENT OF THE INVENTION

The invention applies both to watches provided with a mechanical movement and to watches provided with an electromechanical movement. It can even apply to an electronic watch without hands.

In the case of a mechanical movement, the watch is provided with additional features of an electronic nature. This watch can include a digital screen which extends over a portion of the dial, intended to display the time by way of hands, and on which various data are displayed, such as the date, the time, alphanumerical messages or other information accessible, for example, by browsing one or more menus. The watch comprises a stem-crown winding and hand-setting mechanism that is well known in the prior art. According to this embodiment of the invention, the crown is further used as a means for controlling electronic features, by way of an array of sensors forming proximity sensors which are used to detect a tilting of the crown in two directions orthogonal to the axial direction of the stem.

Figure 1:
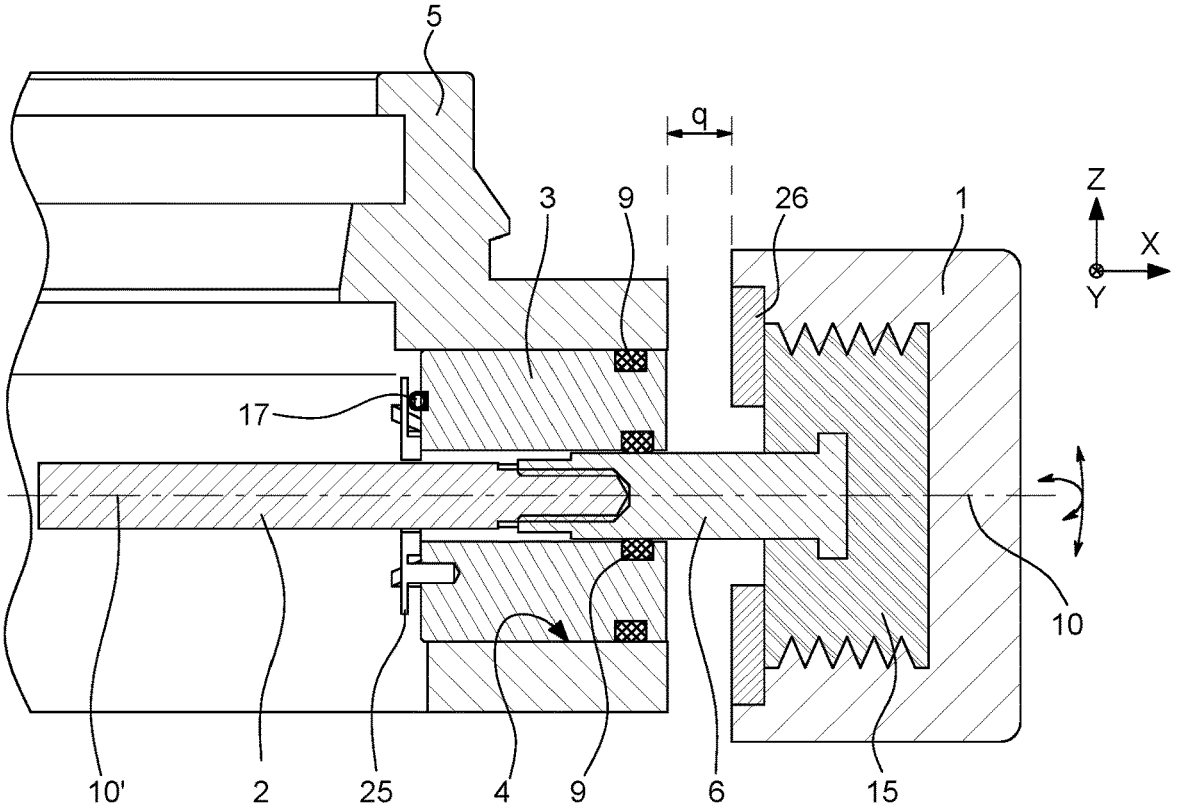
FIG. 1 shows a vertical section of the stem-crown mechanism incorporating a 'joystick' feature into a watch according to one embodiment of the invention.
Figure 2:
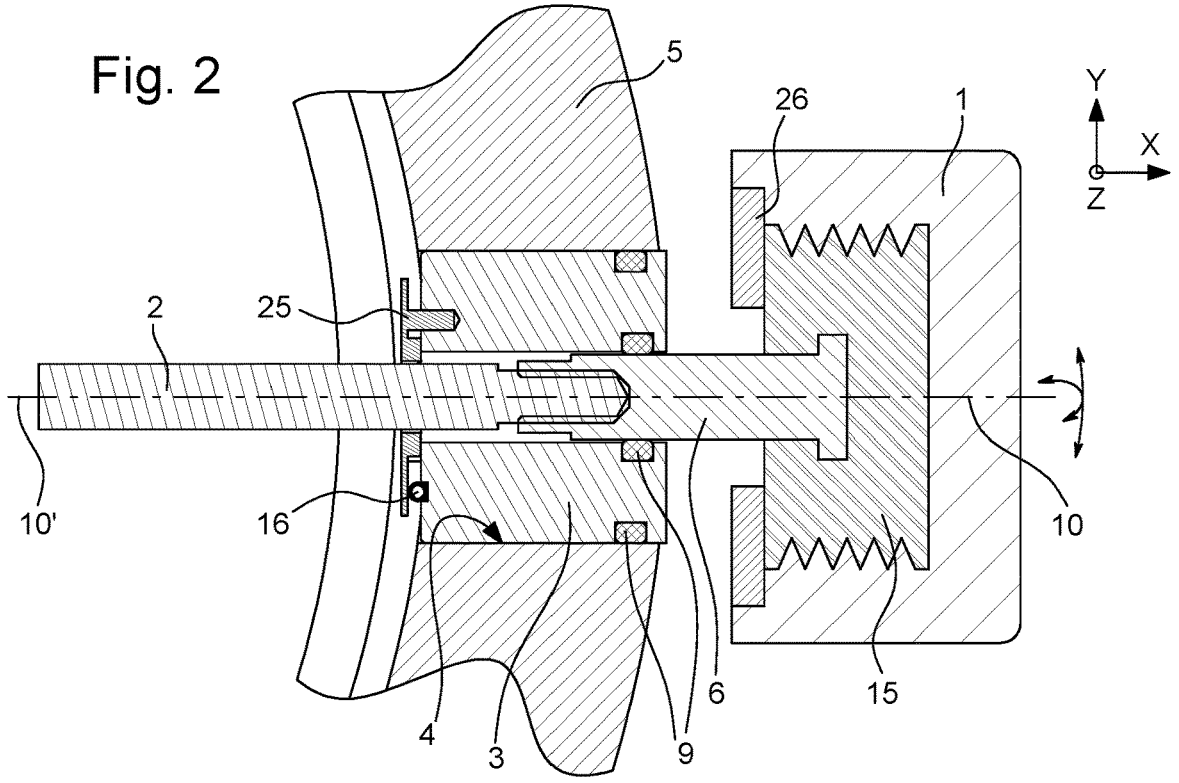
FIG. 2 shows a horizontal section of the mechanism in FIG. 1.
Figure 3:
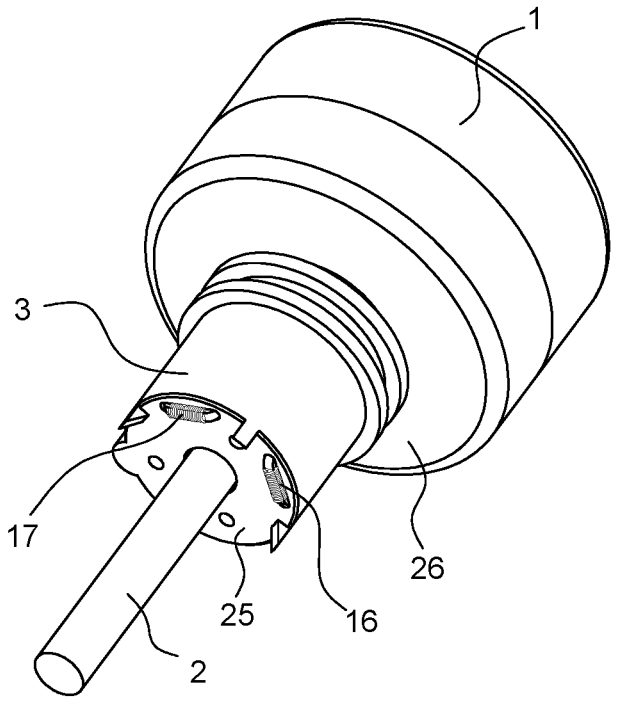
FIGS. 3 and 4 show the manner in which two variable reluctance magnetic sensors are mounted in the middle of the watch according to the embodiment in FIGS. 1 and 2.
Figure 4:
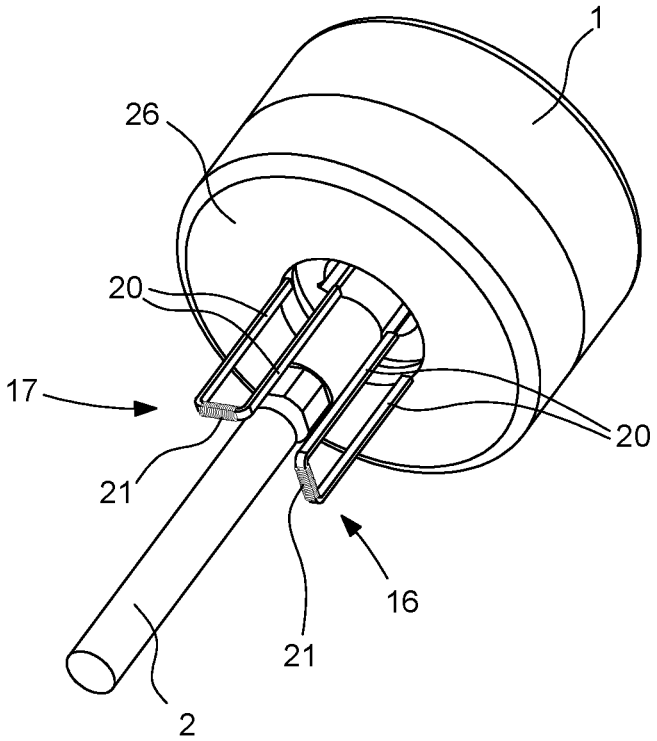
Figure 5:
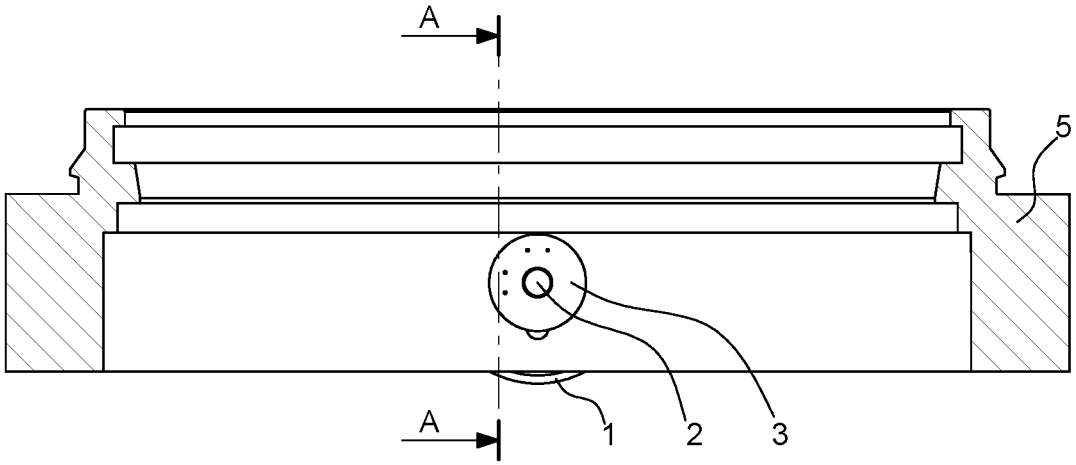
FIGS. 5 and 6 are sections showing the configuration of one of the magnetic sensors incorporated into the watch in FIGS. 1 and 2.
Figure 6:
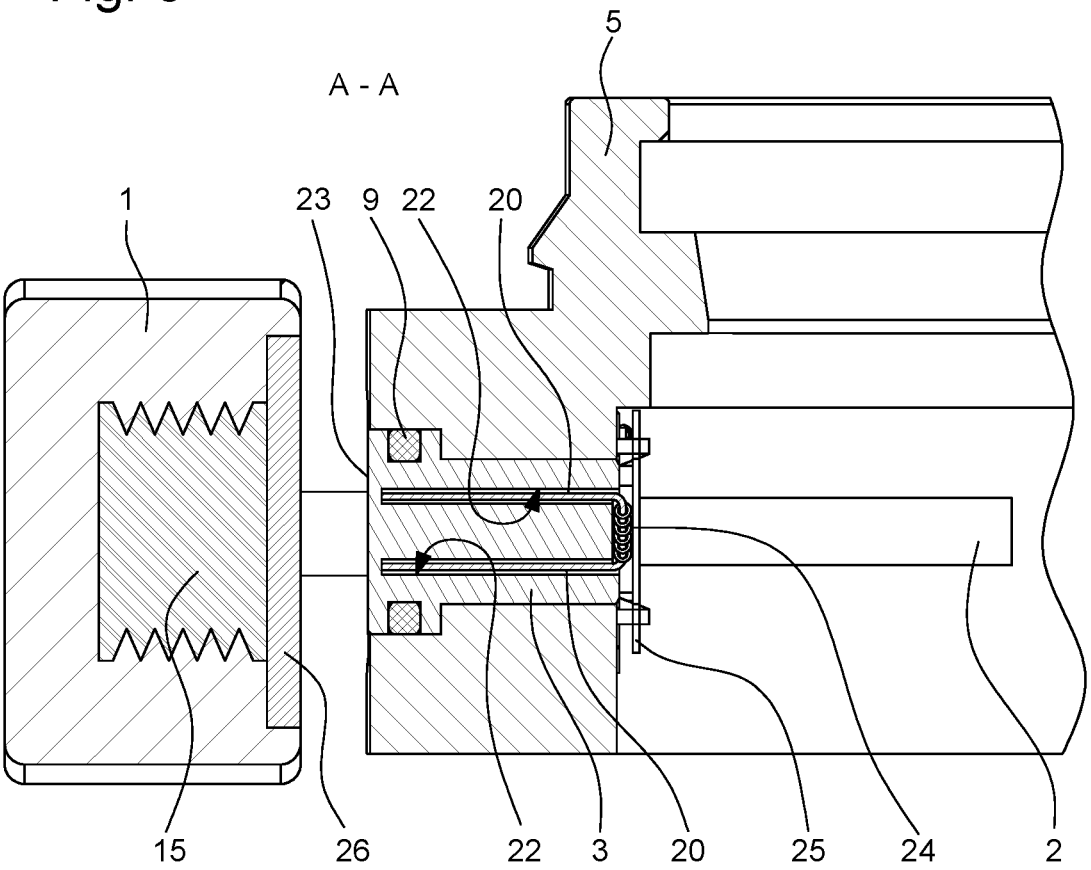

FIGS. 1 and 2 show vertical and horizontal cross-sections of the stem-crown mechanism in a watch according to one embodiment of the invention. In a known manner, the crown 1 is connected to a winding stem 2 by way of a stem-connector 6 driven onto one end of the stem 2. The stem 2 and stem-connector 6 assembly passes through a tube 3 mounted in a fixed manner inside a hole 4 made in the wall of the middle 5 of the watch. In the finished watch, the middle 5 forms the support inside which is installed a horological movement capable of being set by the stem-crown mechanism. O-rings 9 are inserted between the tube 3 and the middle 5 and between the tube and the stem-connector 6 to ensure that the mechanism is sealed. The crown is mounted on one side of the stem-connector 6, such that the rotation of the crown about the central axis 10 thereof drives the stem-connector 6 and the stem 2 in rotation, about the central axis 10' thereof, which is coaxial with the central axis 10. The stem-connector 6 is housed inside the tube 3 such that it can rotate, and with a reduced tolerance, such that the stem-connector 6 is essentially unable to move in the radial direction.

The stem-connector 6 and the stem 2 assembly represents one embodiment of an elongated element to which the crown is fastened. It should be noted that this assembly can take different forms depending on the type of watch. In particular, the stem-connector and the stem can form one and the same element. In the case of an exclusively digital watch, a rotating crown can be provided, fastened to an elongated element forming an electronic stem. As a whole, the elongated element is an element that defines a central axis 10' and that projects outside of the middle 5 of the watch, the outer end of this elongated element forming a ball joint for the crown, as described hereinbelow in more detail.

Moreover, the crown 1 is merely one embodiment of a control member mounted laterally relative to the middle and to which the invention is applicable. Another example of such a control member is the head (generally unable to rotate) of a push-piece equipping a chronograph. The invention will be described with reference to the case of a rotating crown, which represents that most commonly encountered in the horological field; however, the scope of the invention is not limited thereto.

It should be noted that the invention is not limited to control members having a designated purpose and linked to the rotation or axial motion of the control member. The scope of the invention further includes a control member that is not able to rotate about the axis of the elongated element, or that is not able to be displaced in the axial direction. In this specific case, the control member is primarily dedicated to the 'joystick' feature according to the invention.

In the figures, the crown 1 is shown in a position that is relatively close to the middle 5, for example at a distance 'q' (shown in FIG. 1) of less than 1 mm. This position is referred to as the 'rest position'. In a manner known per se, this position allows, for example, the user of a mechanical watch to manually wind his/her watch by rotating the crown 1. According to embodiments, and also in a known manner, the crown 1 can be moved away from the middle 5, by manually pulling on this crown and driving the stem 2 in the axial direction, to activate mechanical setting modes such as adjusting the position of the hands and, where appropriate, the date. Different systems exist for setting the axial positioning of the crown 1 and the actuation of the mechanical setting, and the invention is applicable in conjunction with any of these systems. Independently of the system applied, the invention relates to functions added to the crown 1, preferably when located in the rest position.

As shown in FIGS. 1 and 2, the crown 1 is mounted on the stem-connector 6 via a cylindrical unit 15 made of a resilient material, forming a ball joint, which allows the crown 1 to be tilted, in a self-reverting manner, about the Y and Z axes of an orthogonal coordinate system XYZ, the X axis whereof is collinear with the central axis 10' of the stem 2 and with the central axis 10 of the crown. More particularly, the Z axis is substantially perpendicular to the general plane of the middle 5, and the Y axis is in this general plane. The tilting of the crown about the Y and Z axes can be actuated by the user, by manually manipulating the crown 1 relative to the middle 5. The user can tilt the crown about Y or Z separately or simultaneously (the latter being the case for most of the manipulations in two dimensions). The self-reverting nature of the tilting means that the crown reverts to the rest position thereof as soon as the user releases the crown 1. The material of the ball joint 15 is selected such that this self-reverting tilting is feasible. A resilient or elastomer material with adequate flexibility can be used for this purpose.

According to the invention and with reference to FIGS. 3 to 6, two proximity sensors 16 and 17 are integrated into the middle 5, such that these sensors allow the variations in the distance between the middle 5 and the crown 1 to be measured, as a function of the respective rotations of the crown about the Y and Z axes. According to the specific embodiment shown in the figures, the sensors 16 and 17 are integrated into the tube 3, and the tube 3 is incorporated into the wall of the middle.

Preferably, the sensors 16 and 17 are positioned orthogonally to one another. A deviation from this orthogonal positioning is permitted, provided that the tiltings about Y and Z can be derived from the signals measured, taking into account the angular position of the sensors in the YZ plane. Any type of proximity sensor can be used. Preferably, as is the case in the embodiment shown in the figures, variable reluctance magnetic sensors are implemented. FIGS. 3 to 6 show how the sensors 16 and 17 are integrated into the tube 3. Each of the sensors comprises a 'U'-shaped bar. This bar is made of a ferromagnetic material such as ferrite. The bar comprises two legs 20 and a connecting portion 21 between the legs 20. The two legs 20 are inserted into respective blind holes 22 made in the wall of the tube 3, in an axial direction of this tube, such that the ends of the legs 20 are positioned in the vicinity of the lateral outer surface 23 of the tube 3, this surface 23 being located facing the rear part of the crown. The holes 22 could also pass through the tube 3 from end to end. The connecting portion 21 is provided with a solenoid 24 that is connected to a printed circuit board (PCB) 25 attached to the lateral inner surface of the tube 3, and on which means (not shown) for measuring a current passing through the solenoid 24 are located. As shown in the figures, the sensors 16 and 17 are positioned beside the stem-crown mechanism, but at a distance ensuring that the ends of the legs 20 are located facing the inner surface of the crown 1. A ring 26 made of ferromagnetic material (for example ferrite) is incorporated into the rear part of the crown 1, such that the lateral surface of this ring 26 is located facing the ends of the legs 20 of the two sensors, regardless of the angular position of the crown. Each of the U-shaped bars forms a part of a variable reluctance magnetic circuit, the reluctance varying as a function of the axial position of the ring 26 of the crown 1. A change in the distance between the ring 26 and the sensors, obtained by tilting the crown by way of the resilient ball joint, will change the reluctance of at least one of the two magnetic circuits, which will be detected on the basis of a change in the current passing through at least one of the solenoids 24 when a given voltage is applied to each of these solenoids (also called coils).

The rotation of the crown 1 about the Y and Z axes, actuated by the user, thus varies the respective distances between the ring 26 and the two sensors 16 and 17, such that the signals generated by these sensors are representative of these distances and thus of the magnitude of said tilting about the two orthogonal axes Y and Z defining the two dimensions of the tilting motion. It should be noted that a tilting about the Y axis corresponds to a tilting along the Z axis, and vice-versa. These signals can thus be interpreted as instructions for managing the electronic features of the watch, such as browsing a menu displayed on a digital screen of the watch. The crown 1 thus acts in a similar manner to a joystick of a control console for a computer.

A processor (not shown) is embedded in the PCB 25 to process the signals generated by the two proximity sensors and to convert same into instructions which will manage one or more electronic functions of the watch, for example control of a cursor on the digital screen of the watch. Methods and algorithms well known in the computer technology field can be implemented to process the signals and generate instructions. A battery or other electrical power source, such as a photovoltaic cell, is present in the watch to power the components mounted on the PCB 25 and/or other electronic components implemented inside the watch.

The invention is not limited to embodiments provided with two proximity sensors. A watch according to the invention could comprise a single sensor arranged so as to be able to measure a manipulation in a single direction, for example the sensor 16 only. More than two sensors could also be provided, for example four sensors located in four locations about the axis of the crown, in particular corresponding to the 0°, 90°, 180° and 270° angles.

From among the embodiments provided with at least two proximity sensors, specific embodiments include, for example, the allocation of specific functions depending on the direction in which the control member is manipulated in a plane perpendicular to the central axis 10'. For example, in the case of the embodiment shown in the figures, the tilting about the Y axis, detected only by the sensor 17, can control a different feature to that controlled by the tilting about the Z axis, which is detected only by the sensor 16. In such a case, the processor is preferentially configured such that a slight deviation from the axis of rotation of the tilting relative to the Y and Z axes will be disregarded.

According to other embodiments, the crown 1 (or any other control member to which the invention is applicable) is capable of undergoing a self-reverting axial displacement from the rest position, in the same manner as a push-piece of a chronograph. This axial displacement is actuated by the user, who briefly pushes the crown towards the middle 5 then releases the crown, which automatically reverts to the initial position thereof. This can take place, for example, when the crown 1 is assembled with the stem 2 via a spring-mounted push-piece mechanism that is known per se. According to embodiments pertinent to the invention, the watch is provided with a sensor arranged so as to detect this axial displacement such that the processor generates, in response thereto, a specific instruction that is different from the instructions generated by the tilting of the crown. The instructions generated by pushing the crown can be instructions confirming a selection from among the options presented, for example, in a menu. The revertible push can also be used to activate or deactivate the 'joystick' feature of the crown. The duration of the push can determine the instruction. For example, a longer duration for activating or deactivating the 'joystick' feature and a shorter duration for confirming a selection once the feature is active.

According to a preferred embodiment, the sensors 16 and 17 themselves are used to detect the revertible pushing of the crown towards the middle. This takes place by configuring the processor such that an axial displacement of the crown, causing this crown, and thus the ferromagnetic ring 26 to move closer to the two sensors, which is thus detected simultaneously by the two proximity sensors, is interpreted to be a revertible pushing of the crown. More specifically, unlike the case of tilting, an axial displacement of the crown generates the same distance variation (the same reduction in the distance 'q') for both sensors arranged so as to detect this distance variation. Alternatively, an additional sensor can be implemented, which sensor is specially configured so as to detect the axial displacement of the crown towards the middle. For example, a pair of galvanic contacts could be provided, which touch one another when the crown is pushed, or more advantageously a capacitive sensor could be implemented.

The invention claimed is:

1. A watch comprising a watch case that comprises:
a middle,
a horological movement inside the middle, and
a control member mounted laterally relative to the middle;
the control member being mounted at an end of an elongated element which projects outside the middle and which defines a central axis, the watch being provided with at least one feature that is capable of being managed by at least one electric signal; wherein:
the control member is mounted in a resilient manner on the elongated element such that a user of the watch can move the control member in rotation, in a self-reverting manner, about at least one geometrical axis perpendicular to said central axis and to thereby tilt the control member about the at least one geometrical axis,
the watch is provided with at least one proximity sensor which is configured such that, when the control member is in at least one axial position, it is able to measure a variation in a distance between a part of the control member, that is spaced apart from said central axis, and the middle at at least one location positioned such that said proximity sensor can generate an electric signal representative of the tilting of the control member about said geometrical axis,
the watch includes a processor configured so as to produce an instruction which manages said feature on a basis of said electric signal generated by the sensor.

2. The watch according to claim 1, wherein the control member is mounted on the elongated element by way of a unit made of a resilient material forming a ball joint.

3. The watch according to claim 1, the control member is a rotating crown arranged so as to drive the elongated element in rotation about the central axis when a user rotates the rotating crown to implement a primary feature other than said feature managed on the basis of said electric signal.

4. The watch according to claim 1, wherein the control member is a head of a push-piece, a primary feature whereof is an activation of a feature of a chronograph with which the watch is equipped, said primary feature being different to said feature managed on the basis of said electric signal.

5. The watch according to claim 1, wherein the proximity sensor is a variable reluctance magnetic sensor.

6. The watch according to claim 5, wherein the proximity sensor comprises a 'U'-shaped bar made of a ferromagnetic material, the bar comprising two legs and a connecting portion and being provided with a solenoid, the two legs being arranged in the lateral wall of the middle such that free ends of these two legs are located in close proximity to the lateral outer surface of the middle and facing a ferromagnetic material forming said part of the control member, the solenoid being connected to a means for detecting an intensity of a current passing through said solenoid when the latter is subjected to a voltage.

7. The watch according to claim 1, wherein the watch comprises two proximity sensors mounted orthogonally to said central axis.

8. The watch according to claim 1, wherein the watch comprises at least two proximity sensors wherein separate features of the watch are managed by the tilting of the control member about separate respective axes, said separate axes being defined by the respective positions of the proximity sensors.

9. The watch according to claim 1, wherein the control member is capable of undergoing an axial, self-reverting displacement relative to the middle, from said axial position; and wherein the watch comprises at least one sensor arranged so as to detect said axial displacement, and the processor is configured so as to produce, in response to said axial displacement, an instruction that is different to the instructions generated by the tilting of the control member.

10. The watch according to claim 9, wherein the watch comprises two proximity sensors mounted orthogonally to said central axis, and wherein said at least one detector of the axial displacement is formed by the two proximity sensors.

11. The watch according to claim 9, wherein an instruction generated by the detection of said axial displacement is the activation or deactivation of the detection of the tilting of the control member.

12. The watch according to claim 9, wherein an instruction generated by the detection of said axial displacement is a confirmation of a selection.

13. The watch according to claim 1, wherein the horological movement is a mechanical movement.

* * * * *